United States Patent [19]

Imai et al.

[11] 4,145,902

[45] Mar. 27, 1979

[54] ROLLING MILL

[75] Inventors: Isao Imai, Yokohama; Hiroyuki Shiozaki, Yokosuka, both of Japan

[73] Assignee: Ishikawajima-Harima Jukogyo Kabushiki Kaisha, Tokyo, Japan

[21] Appl. No.: 880,934

[22] Filed: Feb. 24, 1978

[30] Foreign Application Priority Data

May 27, 1977 [JP] Japan ..... 52-62666

[51] Int. Cl.[2] ..... B21B 37/00

[52] U.S. Cl. ..... 72/8; 72/17; 72/205

[58] Field of Search ..... 72/8–12, 72/205, 199, 366

[56] References Cited

U.S. PATENT DOCUMENTS

| | | | |
|---|---|---|---|
| 3,709,017 | 1/1973 | Vydrin et al. | 72/205 |
| 3,811,307 | 5/1974 | Vydrin et al. | 72/205 |

*Primary Examiner*—Milton S. Mehr

*Attorney, Agent, or Firm*—Scrivener, Parker, Scrivener & Clarke

[57] ABSTRACT

A rolling mill capable of rolling a sheet metal into a final product under a low rolling pressure without the need of wrapping the sheet metal around a pair of work rolls. The pair of work rolls are rotated at different peripheral velocities, and the tensions exerted to the sheet metal entering and leaving the pair of work rolls as well as the degree of reduction are so controlled that the ratio of the peripheral velocity of one of the pair of work rolls which is rotated faster than the other work roll to the peripheral velocity of the other work roll may be substantially maintained equal to the elongation ratio of the thickness of the metal sheet entering the pair of work rolls to the thickness of the metal sheet leaving the work rolls.

2 Claims, 5 Drawing Figures

ROLLING MILL

DETAILED DESCRIPTION OF THE INVENTION

The present invention relates to generally a rolling mill and more particularly a rolling mill wherein a pair of upper and lower work rolls are rotated at different peripheral velocities in such a way that one work roll which is rotated slower than the other has a peripheral velocity equal to a velocity of metal entering the work rolls while the other work roll has a peripheral velocity equal to a velocity of metal leaving the work rolls.

In rolling metal into sheets, the reduction in rolling load is essential for the reduction in size of rolling mills, wear of rolls and edge drop and for the reduction of hard materials especially having a greater width.

As shown in FIG. 1, in general, the reduction of metal into a sheet c is accomplished by a pair of upper and lower work rolls a and b which have the same diameter and are rotated at the same velocity. Since the peripheral velocities of the upper and lower work rolls a and b are equal, the neutral points $N_1$ and $N_2$ where the metal moves at the same velocity as the surface of the work rolls are on the same vertical line. Ahead of this point, that is, the roll bite portion or zone indicated by the hatched area under the frictional forces which are directed as indicated by the arrows pull the metal into the work rolls so that it is subjected to the horizontal compression forces and the vertical reduction load becomes higher than when there is no friction force.

In a rolling mill shown in FIG. 2, the peripheral velocities of the upper and lower work rolls a and b are different. For instance the lower work roll b is rotated at a peripheral velocity $V_o$ which is slower than the peripheral velocity $V_1$ of the upper work roll a. Furthermore in rolling the following relationship is maintained:

$$V_1/V_o < h_o/h_1$$

where $h_o$ = thickness of the metal entering the work rolls; and $h_1$ = the thickness of the metal leaving the work rolls.

Under these conditions, the lower and upper neutral points $N_1$ and $N_2$ are offset and are located on the arcs of contact so that the frictional forces between the lower work roll b and the metal are directed opposite to the frictional forces between the upper work roll a and the metal as indicated by the arrows. As a result, there exists a zone c' which is not subjected to the horizontal compression, but ahead and after this zone c' the rolling conditions are similar to those of the rolling system shown in FIG. 1, but the rolling load may be considerably reduced as compared with the rolling system shown in FIG. 1.

According to the currently developed rolling drawing process to be referred to RD process, the rolling load may be considerably reduced so that the above described objects may be attained. That is, RD process is carried out under the condition of $$V_1/V_o = h_o/h_1 \text{ and } V_1 < V_o$$

where $V_1$ = the velocity of the work roll a and the velocity $v_1$ of the metal leaving the work rolls;

$V_o$ = the velocity of the work roll b and the velocity $v_o$ of the metal entering the work rolls;

$h_o$ = the thickness of the metal entering the work rolls; and $h_1$ = the thickness of the metal leaving the work rolls.

Under this condition the neutral points $N_1$ and $N_2$ are further offset and coincide with the entering point and the exit point, respectively. The upper and lower frictional forces are opposite in direction so that the metal is not subjected to the horizontal compression at all and the rolling load is independent of the frictional forces and is considerably reduced, whereby the above described objects may be attained.

However RD process has a problem that it is extremely difficult to make the neutral points $N_1$ and $N_2$ coincident with the entering and exit points, respectively. To overcome this problem, as shown in FIG. 4 the metal c is partly wrapped around the upper and lower work rolls a and b at a suitable subtended or wrapping angle $\theta$ so that the conditions of $$v_o = V_o \text{ and } v_1 = V_1$$

may be attained by the use of the frictional forces between the upper and lower work rolls a and b.

When the metal c is wrapped around the upper and lower work rolls of a two-high rolling-mill and when it is assumed that the tension $t_o$ at the entering point to the mill and the tension $t_1$ at the exit point from the mill be maintained constant, the tension $t_b$ at the point to the roll bite zone x and the tension $t_f$ at the point leaving the zone x may be variable within the following ranges:

$$t_o e^{-\mu\theta} \leqq t_b \leqq t_o e^{\mu\theta}$$

$$t_1 e^{-\mu\theta} \leqq t_f \leqq t_1 e^{82\theta}$$

where $\mu$ = coefficient of friction between the upper and lower work rolls a and b and metal c, and e = the base of natural logarithms.

Therefore the automatic thickness adjustment by tension may be accomplished against the roll eccentricity and other external disturbances so that the stable rolling may be ensured. Furthermore the above condition $$V_1/V_o = h_o/h_1$$

is also satisfied so that the upper and lower frictional forces are opposite in direction. As a result rolling load is independent of the frictional forces and is considerably reduced.

Since metal must be wrapped around the work rolls, RD process has the following problems:

(1) It is difficult to pass a metal sheet through rolling mills;

(2) The rolling mills are complex in construction;

(3) Rapid roll wear results; and (4) A rolling mill for rolling a metal sheet having a greater width is in general not provided with backing rolls so that the work rolls tend to deflect.

In view of the above, one of the objects of the present invention is to provide a rolling mill capable of considerable reduction in rolling load to a degree attainable by RD process without the need of wrapping a sheet metal around work rolls.

The present invention will become more apparent from the following description of one preferred embodiment thereof taken in conjunction with FIG. 5 of the accompanying drawings, in which.

Figure 1:
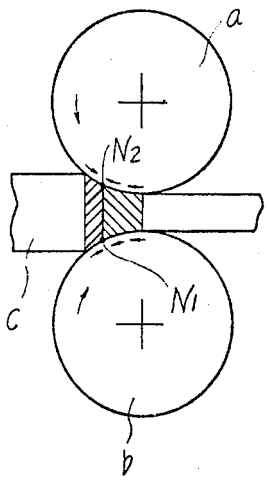
PRIOR ART Fig. 1
FIG. 1 is a schematic view illustrating a prior art rolling method by a pair of upper and lower work rolls having the same diameter and rotating at the same velocity.
Figure 2:
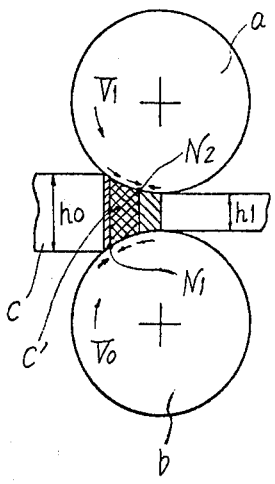
PRIOR ART Fig. 2
FIG. 2 is a schematic view illustrating a prior art rolling method by a pair of upper and lower work rolls which are rotated at different peripheral velocities.
Figure 3:
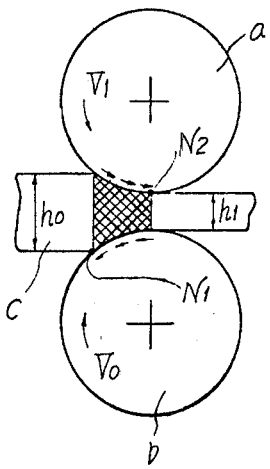
PRIOR ART Fig. 3
FIG. 3 is a schematic view used for the explanation of RD process.
Figure 4:
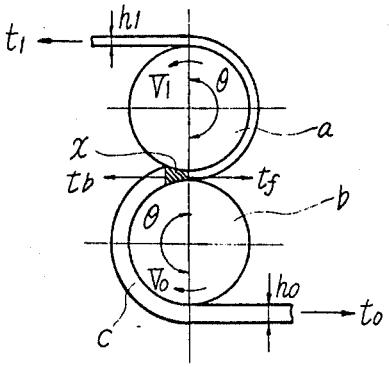
PRIOR ART Fig. 4
FIG. 4 is a schematic view of a RD mill wherein a sheet metal to be rolled is wrapped around the work rolls.
Figure 5:
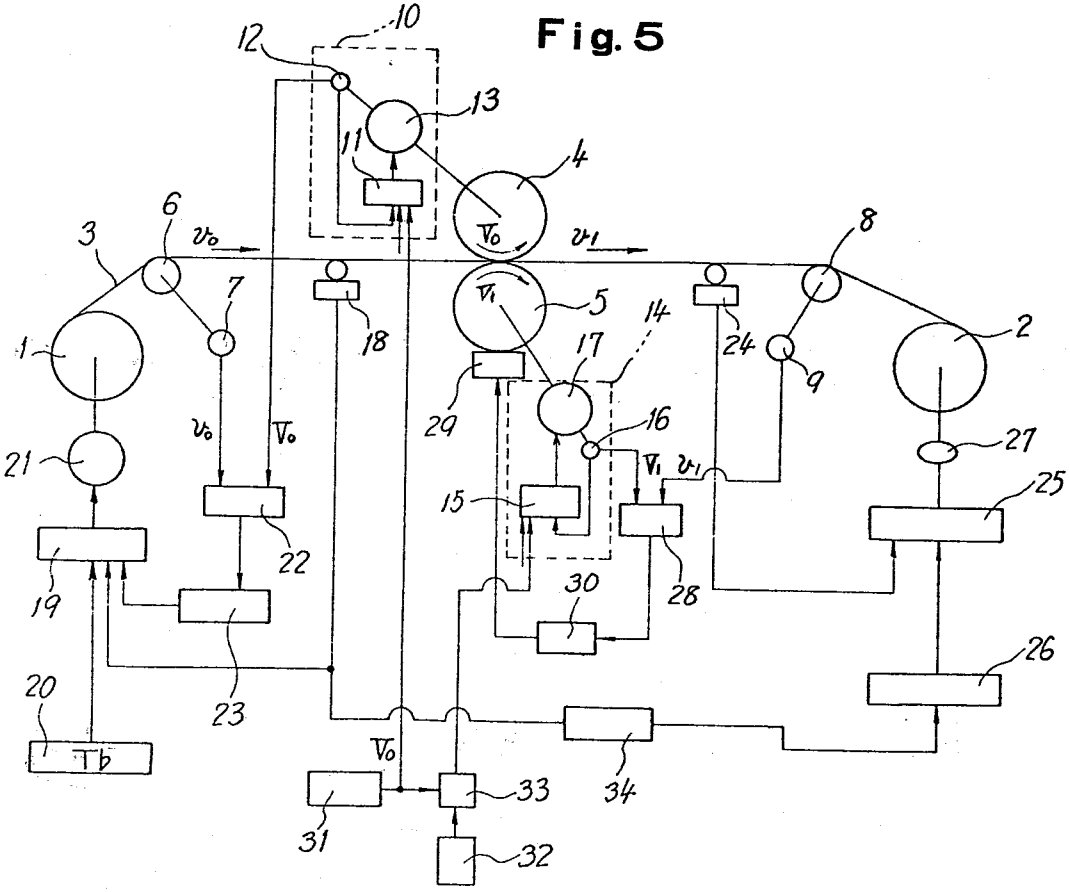
FIG. 5 is a diagrammatic view of a rolling mill in accordance with the present invention.

Referring particularly to FIG. 5, a sheet metal 3 is uncoiled from an uncoiler 1, passes a deflector roller 6, is rolled by a pair of upper and lower work rolls 4 and 5, passes a deflector roll 8 and is coiled again by a recoiler 2.

An inlet velocity detector 7 which is operatively coupled to the deflector roller 6 detects the velocity $v_o$ of the sheet metal 3 entering the roll stand, and the output representative of the entering velocity $v_o$ is applied to a velocity comparator 22. In like manner, an outlet velocity detector 9 which is operatively coupled to the deflector roller 8 detects the velocity $v_1$ of the sheet metal 3 leaving the roll stand, and the output representative of the leaving velocity $v_1$ is applied to a velocity comparator 28.

The velocity $V_o$ of the upper work roll 4 is controlled by an upper work roll velocity regulation unit 10 comprising a velocity control unit 11, an upper work roll velocity detector 12 and a motor 13. In like manner, the velocity of lower work roll 5 is controlled by a lower work roll velocity regulation unit 14 comprising a velocity control unit 15, a lower work roll velocity detector 16 and a motor 17. The velocity $V_1$ of the lower work roll 5 is faster than the velocity $V_o$ of the upper work roll 4. The output from the upper work roll velocity detector 12 is applied to the velocity comparator 22 while the output from the lower work roll velocity detector 16 is applied to the velocity comparator 28.

An inlet tension gage 18 detects the tension of the sheet metal 3 entering the work rolls 4 and 5, the output from the tension gage 18 is applied not only to a tension control unit 19 but also a tension limiter 34. In like manner, an outlet tension gage 24 detects the tension of the sheet metal 3 leaving the work rolls 4 and 5, and the output representative of the tension of the sheet metal 3 leaving the work rolls is applied to a tension control unit 25.

The difference output signal from the velocity comparator 22 is applied to a converter 23 which converts the output signal received into a signal representing the difference in velocity between the metal sheet 3 entering the work rolls 4 and 5 and the upper work roll 4 in terms of a tension, and the output signal from the converter 23 is applied to the tension control unit 19. In like manner, the difference output signal from the velocity comparator 28 is applied to a converter 30 which converts the output signal received into a signal representing the difference in velocity between the sheet metal 3 leaving the work rolls 4 and 5 in terms of a rolling reduction, and the output from the converter 30 is applied to a reduction unit 29 including a reduction control unit (not shown) for controlling a motor (not shown) so as to control the gap between the upper and lower work rolls 4 and 5.

In response to the signal Tb from a tension set unit 20 and the output from the inlet tension gage 18 and the converter 23, the tension control unit 19 controls the torque produced by a motor 21, thereby maintaining a predetermined tension of the sheet metal 3 entering the work rolls 4 and 5. In like manner, in response to the output from the outlet tension gage 24 and the signal from a tension set unit 26, the tension control unit 25 controls the torque produced by a motor 27, thereby maintaining a predetermined tension of the sheet metal 3 leaving the work rolls 4 and 5. When the tension detected by the inlet tension gage 18 exceeds a predetermined level, the tension limiter 34 generates the output which is transmitted through the tension set unit 26 to the tension control unit 25. Therefore in response to the tension detected by the inlet tension gage 18, the tension control unit 25 can also control the tension of the metal sheet 3 leaving the work rolls 4 and 5.

The signal representative of a preset upper work roll velocity $V_o$ generated by a velocity set unit 31 is applied not only to the velocity control unit 11 in the upper work roll velocity regulation unit 10 but also to a multiplier 33. An elongation rate set unit 32 generates a signal representative of a preset elongation rate which is applied to the multiplier 33. The multiplier 33 mutiplies the output from the velocity set unit 31 and the elongation rate set unit 32, and the product representative of a predetermined peripheral velocity $V_1$ ($V_o \times h_o/h_1$) is applied to the lower work roll velocity control unit 15 in the lower work roll velocity regulation unit 14.

Next the mode of operation will be described. In response to the signal Tb from the tension set unit 20 and the output from the inlet tension gage 18, the tension control unit 19 controls the torque of the motor 21 so that the uncoiler 1 supplies the sheet metal 3 at the velocity $v_o$. In response to the signal from the velocity detector 12 and the velocity set unit 31, the velocity control unit 11 controls the motor 13 so that the upper work roll 4 is rotated at the present velocity $V_o$. In like manner, in response to the output from the velocity detector 16 and the output from the multiplier 33 the velocity control unit 15 controls the motor 17 so that the lower work roll 5 is rotated at the predetermined peripheral velocity $V_1$ faster than the velocity $V_o$. In response to the output signal from the outlet tension gage 24 and the output from the tension set unit 26, the tension control unit 25 controls the torque of the motor 27 so that the velocity of the sheet metal leaving the work rolls 4 and 5 may be maintained at the predetermined sheet velocity $v_1$. The inlet and outlet velocity detectors 7 and 8 also detect the velocities $v_o$ and $v_1$ of the sheet metal 3 entering and leaving the work rolls 4 and 5.

According to the present invention, the metal sheet 3 is rolled under the conditions that the peripheral velocity $V_o$ of the upper work roll 4 is slower than the peripheral velocity $V_1$ of the lower work roll 5 and that the ratio of the velocity $V_1$ of the upper work roll 4 to the velocity $V_1$ of the lower work roll 5 is equal to the elongation ratio of the thickness $h_o$ of the sheet metal 3 entering the work rolls 4 and 5 to the thickness $h_1$ of the sheet metal 3 leaving the work rolls 4 and 5, whereby the neutral point between the sheet metal 3 and the upper work roll 4 which is rotated slower than the lower work roll 5 is located at the entering point to the work rolls 4 and 5 while the neutral point between the sheet metal 3 and the lower work roll 5 is located at the exit point. That is, $$V_1/V_o \approx v_1/v_o = h_o/h_1 = \lambda$$

$$V_1 = v_1$$

$$V_o = v_o$$

and $$V_o < v_1$$

where $V_1$ = the peripheral velocity of the lower work roll 5, $V_o$ = the peripheral velocity of the upper work roll 4, $v_1$ = the velocity of the sheet metal leaving the work rolls, $v_o$ = the velocity of the sheet metal entering the work rolls, $h_o$ = the thickness of the sheet metal entering the work rolls, $h_1$ = the thickness of the sheet metal leaving the work rolls, and $\lambda$ = elongation rate.

In order to maintain the above conditions, in response to the signal from the velocity set unit 31, the upper work roll velocity regulation unit 10 controls and maintains the velocity of the upper work roll 4 at $V_o$ while in response to the signal from the elongation ratio set unit 33 which multiplies the velocity $V_o$ and the elongation ratio $\lambda$, the lower work roll velocity regulation unit 14 controls and maintains the velocity of the lower work roll 5 at $V_1$ which is faster than $V_o$. In order to control the tensions in response to the peripheral velociy ratio $V_1/V_o$, the torque of the uncoiler 1 and recoiler 2 are controlled. In order to maintain the conditions $$v_o = V_o, \text{ and } v_1 = V_1$$

the velocities $v_o$ and $v_1$ of the sheet metal 3 entering and leaving the work rolls 4 and 5 are detected and compared with the peripheral velocities $V_o$ and $V_1$ of the upper and lower work rolls 4 and 5, and the tensions exerted to the metal sheet 3 entering the work rolls 4 and 5 is controlled by the tension control unit 19 and the roll gap is controlled by the reduction unit 29 so that the difference in velocity between the sheet metal 3 entering the work rolls 4 and 5 and the upper work roll 4 may become zero while the difference in velocity between the sheet metal 3 leaving the work rolls 4 and 5 and the lower work roll 5 may also become zero.

More particularly, when the rolling force exerted between the upper and lower work rolls 4 and 5 and the gap therebetween are not optimum, the sheet metal 3 is too much slackend or tensioned so that there are differences between the velocity $v_o$ of the sheet metal 3 entering the work rolls and the velocity $V_o$ of the upper work roll 4 and between the velocity $v_1$ of the sheet metal leaving the work rolls and the velocity $V_1$ of the lower work roll 5. Therefore the reduction is previously set depending upon the elongation ratio $\lambda$, but the correct setting is extremely difficult so that the reduction is controlled or corrected in response to the difference between the sheet metal velocity and the work roll velocity as will be described in detail hereinafter.

The velocity $v_o$ of the sheet metal 3 entering the work rolls 4 and 5 is detected by the inlet velocity detector 7, and the peripheral velocity $V_o$ of the upper work roll 4 is detected by the upper work roll velocity detector 12. These detected velocities $v_o$ and $V_o$ are compared in the velocity comparator 22, and the difference output signal from the comparator 22 is converted into the signal representing the velocity difference in terms of a tension. In response to the output signal from the converter 23 the tension control unit 19 corrects the torque of the uncoiler 1, thereby correcting the tension exerted to the sheet metal 3 entering the work rolls 4 and 5. Thus the velocity $v_o$ of the sheet metal 3 entering the work rolls 4 and 5 is made equal to the peripheral velocity $V_o$ of the upper work roll 4. (Alternatively, the ratio of the sheet metal velocity $v_o$ to the upper work roll velocity $V_o$ may be maintained at a predetermined constant ratio.) In response to the signal Tb from the tension set unit 20 and the output from the inlet tension gage 18 representative of the tension exerted to the sheet metal 3 entering the work rolls 4 and 5, the tension control unit 19 also maintains the tension of the sheet metal 3 at the predetermined level Tb.

In like manner the velocity $v_1$ of the sheet metal 3 leaving the work rolls 4 and 5 is detected by the outlet velocity detector 9, and the velocity $V_1$ of the lower work roll 5 is detected by the lower work roll velocity detector 16 in the lower work roll velocity regulation unit 14. These detected speeds $v_1$ and $V_1$ are compared in the velocity comparator 28, and the output from the comparator 28 representing the difference in velocity between the metal sheet and the lower work roll is converted by the converter 30 into the signal representing the velocity difference in terms of a tension. In response to the output from the converter 30 the reduction unit 29 corrects the gap between the upper and lower work rolls 4 and 5 in such a way that the sheet metal velocity $v_1$ may be equal to the lower work roll velocity $V_1$. Therefore the above described fundamental conditions are always satisfied so that the reduction with a predetermined elongation ratio may be carried out.

When the tension exerted to the sheet metal 3 entering the work rolls 4 and 5 exceeds a predetermined level, the tension limiter 34 generates the signal which is transmitted through the tension set unit 26 to the tension control unit 25. Therefore the tension control unit 25 may also control the tension of the sheet metal 3 leaving the work rolls 4 and 5. To this end, the tension limiter 34 must be so set that an optimum tension control may be attained.

It is to be understood that the present invention is not limited to the preferred embodiment described above with reference to FIG. 5. For instance, the sheet metal 3 may be reversed from the recoiler 2 to the uncoiler 1. So far the present invention has been described as controlling the sheet metal velocity and the work roll velocity in such a way that $v_o = V_o$, and $v_1 = V_1$, but in practice it suffices to minimize the difference between them.

The effects, features and advantages of the present invention may be summarized as follows:

(I) Opposed to RD process, the wrapping of metal sheet around work rolls may be eliminated, but metal sheets may be rolled into final products having excellent surface qualities under a low rolling pressure comparable to that used in RD process.

(II) Because of (I), the problems and defects resulting from the wrapping of a sheet metal around the work rolls may be completely overcomed.

(III) The tension limiter is provided which generates the signal when the tension detected exceeds a predetermined level, and in response to this signal the tension control unit controls the tension of the sheet metal so that the positive and reliable tension control may be ensured.

What is claimed is:

1. A rolling mill of the the type wherein a pair of work rolls are rotated at different peripheral velocities and the ratio of the peripheral velocity of one of said pair of work rolls which is rotated slower than the other work roll to the peripheral velocity of the other roll is substantially equal to the elongation ratio of the thickness of a metal sheet entering said pair of work rolls to the thickness of the metal sheet leaving said pair of work rolls, which comprises means for detecting the sheet metal velocities at the inlet and outlet, means for controlling the tensions exerted to the sheet metal at the inlet and outlet, means for controlling and maintaining the peripheral velocities of said pair of work rolls at predetermined velocities, and means for controlling one of said tension control means and means for controlling reduction means so that any velocity differences between said one work roll and the metal sheet entering said work rolls and between said the other work roll and the metal sheet leaving said work rolls may be minimized, such velocity diferences being found by the comparison of the signals from said means for controlling the peripheral velocity of said one work roll and from said means for detecting the sheet metal velocity at the inlet and by the comparison of the signals from said means for controlling the peripheral velocity of said the other work roll and from said means for detecting the sheet metal velocity at the outlet.

2. A rolling mill as set forth in claim 1 wherein said sheet metal tension control means at the inlet or the outlet is responsive to the signal from sheet metal tension detecting means and to the signal from tension setting means so that the sheet metal velocities entering or leaving said pair of work rolls may be controlled in response to the tensions exerted to said sheet metal entering or leaving said pair of work rolls; and said sheet metal tension control means is also responsive to the output signal from tension limiter means which generates said output signal when the tension detected by said sheet metal tension detecting means exceeds a predetermined level.

* * * * *